United States Patent [19]

Imajima

[11] Patent Number: 4,534,727

[45] Date of Patent: Aug. 13, 1985

[54] LIQUID FUEL BURNER HAVING AN OXYGEN SENSOR LOCATED IN A FLAME

[75] Inventor: Mituhiro Imajima, Koriyama, Japan

[73] Assignee: Matsushita Electric Industrial Company, Limited, Japan

[21] Appl. No.: 320,761

[22] Filed: Nov. 12, 1981

[30] Foreign Application Priority Data

Nov. 13, 1980 [JP] Japan ..... 55-160143

[51] Int. Cl.[3] ..... F23N 5/00

[52] U.S. Cl. ..... 431/76; 431/33; 431/201; 431/304; 126/96

[58] Field of Search ..... 431/33, 75, 76, 207, 431/201, 208, 298, 299, 300, 301, 302, 304, 310, 312, 315, 313, 90; 126/95, 96; 204/410, 424, 427; 338/39; 236/15 E, 94; 432/13, 15, 37, 46, 222

[56] References Cited

U.S. PATENT DOCUMENTS

| | | | |
|---|---|---|---|
| 458,901 | 9/1891 | Hervy | 431/309 |
| 1,049,110 | 12/1912 | Lemaster | 431/309 |
| 1,380,135 | 5/1921 | Corbin | 126/248 |
| 1,994,748 | 3/1935 | Breed | 431/309 |
| 2,047,303 | 8/1931 | Albree | 431/200 X |
| 2,247,858 | 7/1941 | Selby | 431/45 X |
| 3,216,661 | 11/1965 | Sawyer | 431/14 X |
| 3,756,764 | 9/1973 | Reichmann | 431/208 X |
| 4,032,286 | 6/1977 | Kobayashi et al. | 431/76 |
| 4,233,596 | 11/1980 | Okamoto et al. | 431/14 X |
| 4,322,968 | 4/1982 | Takami et al. | 338/34 X |
| 4,358,265 | 11/1982 | Tanaka et al. | 431/76 |
| 4,392,813 | 7/1983 | Tanaka et al. | 431/76 |

FOREIGN PATENT DOCUMENTS

| | | | |
|---|---|---|---|
| 139291 | 3/1903 | Fed. Rep. of Germany | 431/309 |
| 1401794 | 10/1968 | Fed. Rep. of Germany . | |
| 54-113531 | 9/1979 | Japan | 431/76 |
| 8577 | 1/1980 | Japan | 431/76 |
| 43335 | 3/1980 | Japan | 431/300 |
| 68507 | 5/1980 | Japan | 431/300 |
| 55-95034 | 7/1980 | Japan | 431/76 |
| 55-102829 | 8/1980 | Japan | 431/77 |
| 176987 | 10/1961 | Sweden | 431/309 |
| 1114730 | 5/1968 | United Kingdom . | |
| 1115889 | 5/1968 | United Kingdom . | |
| 1392773 | 4/1975 | United Kingdom | 431/315 |

*Primary Examiner*—Samuel Scott
*Assistant Examiner*—Carl D. Price
*Attorney, Agent, or Firm*—Lowe, King, Price & Becker

[57] ABSTRACT

In a liquid fuel burner of the type wherein vaporization of the fuel is sustained by the heat of its own flame, an oxygen sensor is located in the flame to provide a signal when the flame diminishes indicating the occurrence of an oxygen shortage condition to permit a safety device to automatically extinguish the flame.

13 Claims, 5 Drawing Figures

LIQUID FUEL BURNER HAVING AN OXYGEN SENSOR LOCATED IN A FLAME

BACKGROUND OF THE INVENTION

The present invention relates to liquid fuel burners of the type wherein the rate of fuel vaporization is chiefly governed by the heat of its own flame with which recirculated air of an enclosed indoor space is warmed, and more particularly to a liquid fuel burner of such type having a safety device operable in response to the occurrence of an oxygen shortage condition.

Oxygen sensors are currently employed as a means for detecting oxygen shortage conditions which are likely to occur in liquid fuel burners of the primary combustion type wherein the fuel is vaporized by an external heat source or in gas burners. The oxygen sensor, either of a partial pressure type or of a concentration differential type, is currently located in an environment which is downstream of the flame and in which the oxygen's partial pressure or concentration is high when the burner is properly operating so that when an oxygen shortage condition occurs the flame extends to such a degree that it encloses the oxygen sensor and as a result the sensor's oxygen environment switches to a low partial pressure or concentration state.

While the current practice is effective for the burners of the type just mentioned, the current practice does not apply to liquid fuel burners of the type such as kerosene heaters and pot burners wherein the rate of fuel vaporization is chiefly governed by the heat produced by its own vaporized fuel since the flame diminishes under oxygen shortage conditions. Therefore, the downstream point of the flame is predominantly of a carbon monoxide environment and the oxygen sensor, if located thereat, would not provide a valid indication. With burners in which secondary air is introduced for combustion of unburned fuel, there is no distinct variation in the amount of oxygen at the downstream point.

SUMMARY OF THE INVENTION

According to the present invention, the liquid fuel burner comprises means for vaporizing the liquid fuel, means for igniting the vaporized fuel, means for forming a combustion area in which the ignited fuel is mixed with air to thereby generate a flame so that the heat generated by the flame causes the vaporizing means to increase the rate of vaporization, an oxygen sensor located in the flame which indicates that the burner is operating properly, and a safety device operable in response to an output signal from the oxygen sensor.

Preferably, the oxygen sensor is located in the flame of a final stage of combustion and the burner further includes means for forcibly supplying air to the combustion area regardless of the amount of the oxygen contained therein. The use of a tin oxide oxygen sensor is preferred since its output signal is variable as a function of partial pressure of oxygen and temperature.

BRIEF DESCRIPTION OF THE DRAWINGS

The invention will be described in further detail with reference to the accompanying drawings, in which.

DETAILED DESCRIPTION

Figure 1:
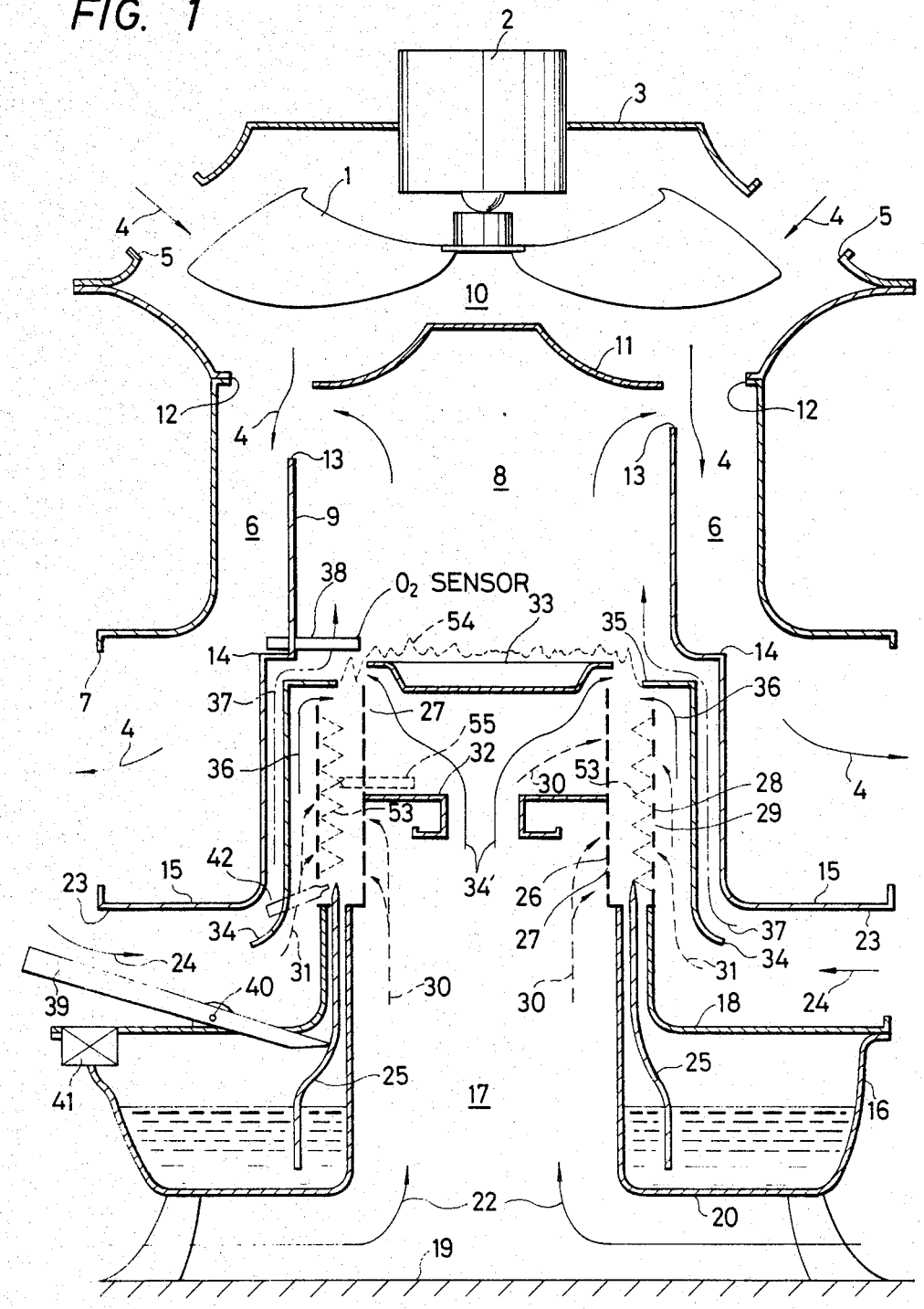
FIG. 1 is a cross-sectional view of a liquid fuel burner of a preferred embodiment of the invention.
Figure 2:
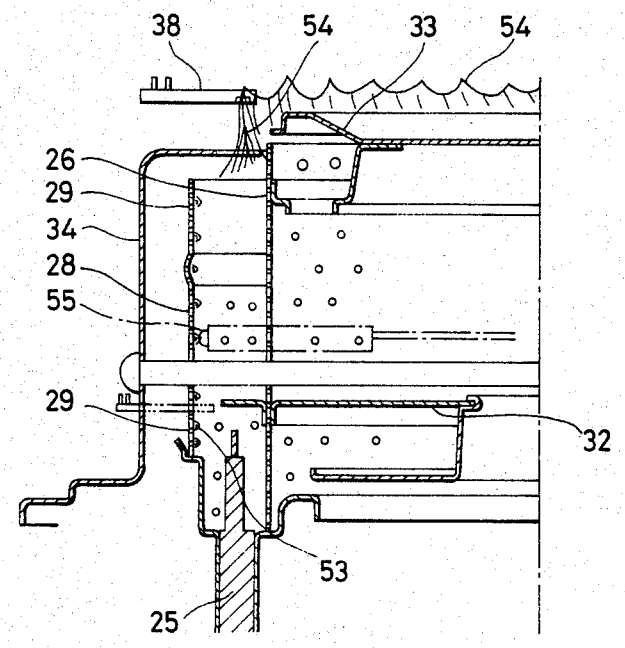
FIG. 2 is a cross-sectional view, in part, of the liquid fuel burner.

Referring now to FIGS. 1 and 2, a preferred embodiment of the present invention is illustrated schematically in cross-section. For the purpose of illustration the invention is embodied in a liquid fuel burner using a fibrous capillary wick immersed in a liquid fuel container for vaporizing the fuel through the action of capillary. A flame is initially triggered by an ignitor and sustained thereafter by the fuel vapor generated under its own heat. Therefore, the burner of this type is characterized by the process of selfheating vaporization.

In FIG. 1, the liquid fuel burner of the self-vaporization type comprises a blower fan 1 within an upper chamber 10 and attached to a motor 2 secured on a top plate 3 to produce downward drafts of air as indicated by arrows 4 through upper inlets 5, side vertical chambers 6 and through side outlets 7 out into the atmosphere. The side vertical chambers 6 are separated from an inside flame generating chamber 8 by a cylindrical wall 9 and the latter is in turn separated from the upper chamber 10 by a deflector plate 11 which causes forced airstreams to move past side openings 13 defined between the deflector 11 and cylindrical wall 9. Venturi action is thus produced which causes heated air from within the flame generating chamber 8 to escape through the openings 13 and side chambers 6 out into the atmosphere for space heating. The cylindrical wall 9 is formed to have upper and lower sections with an outwardly stepped shoulder portion 14 therebetween and a outwardly extending flange 15 formed at the lowermost end of the lower section. A fuel tank 16, having a center opening 17 and a flanged top 18, is secured to a base member 19. The bottom surface 20 of the tank 16 is spaced from the floor formed by base member 19 to admit cool air as indicated by arrows 22 through the opening 17 radially outwardly to the combustion area of the burner and its flanged top 18 is spaced from the flange 15 to define lateral openings 23 to admit cool air indicated by arrows 24 radially inwardly to the combustion area.

A cylindrically shaped wick 25 is partially immersed in the liquid fuel contained in the tank 16 and extends upward through a space between inner and outer cylindrical walls of the tank terminating in a primary combustion chamber located above the upper ends these walls. The primary combustion chamber is defined by a space between a perforated inner cylinder 26 having plural side openings 27 and a perforated outer cylinder 28 located concentrically with respect to the inner cylinder 26 and having plural side openings 29 which are larger in size than the side openings 27 of the inner cylinder 26. Primary air is introduced into the primary combustion chamber through the openings 27 on the one hand and through the openings 29 on the other hand as indicated by broken-line arrows 30 and 31, respectively, to produce primary flames on the inner surface of the outer cylinder 28 in positions correspoding to the openings 29. An annular-shaped deflector plate 32 is fitted to the inner cylinder 26 at a midpoint of its vertical length.

Spacedly mounted from the upper edge of the perforated inner cylinder 26 is a disk-shaped flame distributing member 33 to allow introduction of air as secondary air indicated by solid-line arrows 34' to a point above the primary combustion chamber. Between the perforated outer cylinder 28 and the lower section of the cylindrical wall 9 is provided a cylindrical separator 34 having an inwardly extending flange 35 on its upper end. The flange 35 is spaced both from the shoulder 14 and the upper edge of the perforated outer cylinder 28 to allow introduction of air as part of the secondary air indicated by solid-line arrows 36 to a point slightly below the point where the secondary air indicated by the arrows 34' is introduced to produce a secondary flame on the circumference of the disk 33 and introduction of tertiary air as indicated by chain-dot-line arrows 37 to a point above the secondary flame.

According to a preferred embodiment of the invention, an oxygen sensor 38 is located in the secondary combustion flame when the burner is operating properly for detecting the partial pressure of oxygen. The oxygen sensor 38 is formed of a reduction type semiconductive material which decreases its resistance as a function of the partial pressure of oxygen or formed of an oxidization type semiconductive material which decreases its resistance as a function of the partial pressure of oxygen. Suitable materials of the reduction type oxygen sensor include $SnO_2$, $TiO_2$, $Fe_2O_3$, ZnO, $V_2O_5$, MnO, $WO_3$, $ThO_2$, $MoO_3$, CdO, $Al_2O_3$, and $PbCh_4$, and suitable materials of the oxidization type include NiO and $Ch_2O_3$. The oxygen sensor may also be formed of the pressure differential type as exhibited by $ZrO_2$ or the like whose output is a function of oxygen concentration.

The wick 25 is manually raised to an operating position by means of a spring-biased lever 39 pivoted at 40 on the fuel tank 16. A solenoid 41 is provided on the tank in a position adjacent to the pivot point 40 remote from the wick 25 to magnetically lock the lever 39 in an operating position against the spring action of the lever 39. An ignitor 42 is located adjacent to the upper edge of the wick 25.

Figure 3:
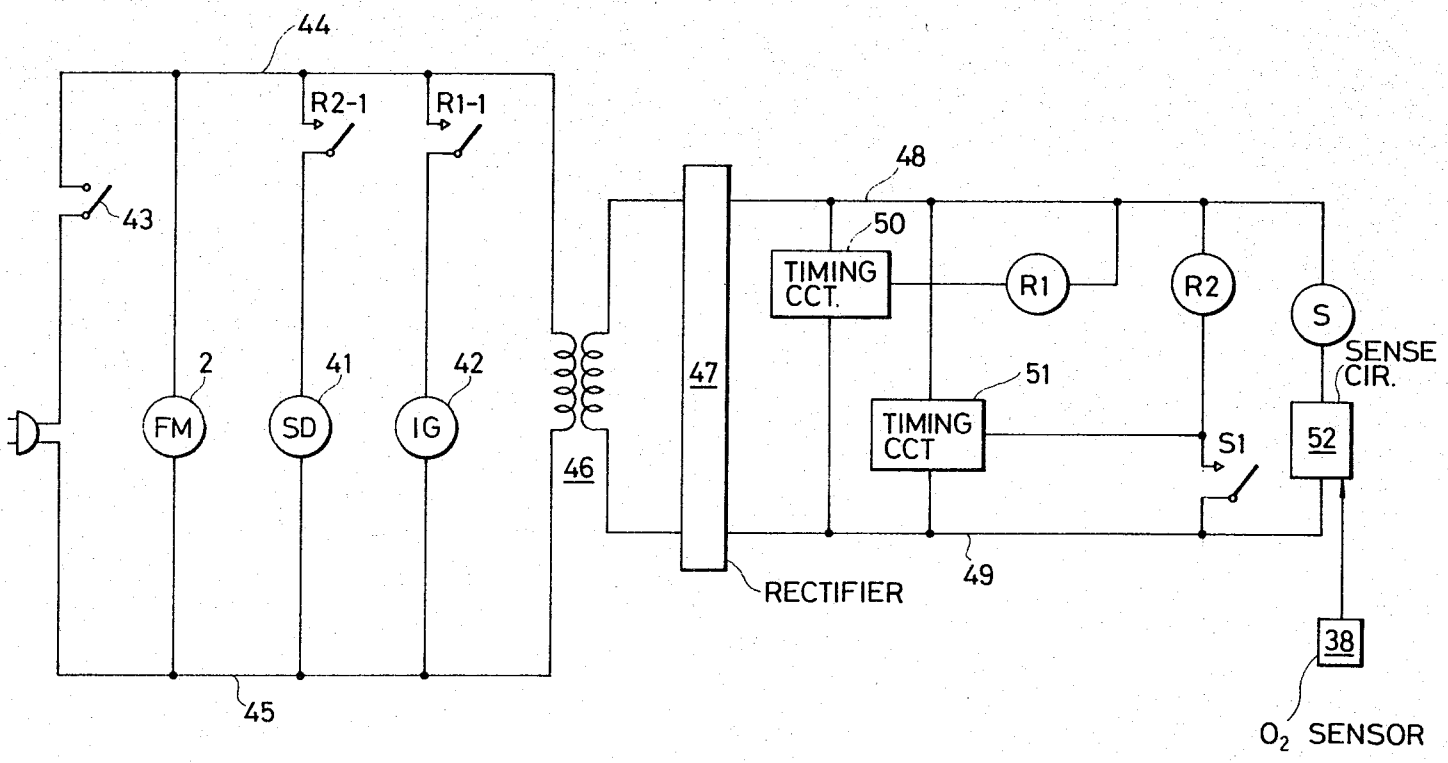
FIG. 3 is a circuit diagram of the liquid fuel burner.

FIG. 3 illustrates a circuit diagram of the burner of the invention. The circuit is energized by a power switch 43 which is operatively coupled to the lever 39 to close its contacts to couple an a.c. voltage to power lines 44 and 45 across which the fan motor 2 is connected. A transformer 46 is provided having its primary winding connected across the power lines 44, 45 and its secondary winding connected to a rectifier 47 to supply a d.c. voltage to d.c. power lines 48 and 49. Timing circuits 50 and 51 having different time constant values are coupled across the d.c. power lines 48 and 49 to start respective timing operations in response to the operation of the lever operated power switch 43. During the periods respectively set by the timing circuits 50 and 51, relays R1 and R2 are respectively energized to close their relay contacts R1-1 and R2-1. The ignitor 42, connected in series with the relay contacts R1-1 across the a.c. power lines, is thus energized briefly to ignite the fuel vaporized by the capillary action of the wick 25. The lever holding solenoid 41, connected in series with the relay contacts R2-1 across the a.c. power lines, is energized to lock the lever 39 in position. The oxygen sensor 38 is electrically connected to a sense circuit 52 which completes a d.c. circuit for a relay S. The circuit energizes the relay S when the sensor 38 has a lower resistance and de-energizes it when the sensor switches to a higher resistance state indicating a shortage of oxygen. The relay S has its contacts S1 connected in series with the relay R2 across the d.c. power lines 48, 49 so that the relay R2 and hence the solenoid 41 remains energized until oxygen shortage condition is detected the interconnection between the solenoid biasing the wick and the output of the oxygen sensor is symbolically shown in FIG. 5.

The operation of the liquid fuel burner of the invention is as follows. When the vaporized fuel is ignited, streams of primary air indicated by arrows 30 are admitted radially outwardly through the openings 27 of the perforated inner cylinder 26 into a primary combustion chamber directly above the wick 25 and streams of primary air indicated by arrows 31 are admitted radially inwardly through the openings 29 of the perforated outer cylinder 28 into the primary combustion chamber. Due to the relatively larger size of the openings 29 to openings 27, primary combustion flames 53 are produced on the inner wall of the outer cylinder 28 corresponding to the openings 29. The heat produced by the primary combustion flames 53 acts in a way to accelerate the rate of fuel vaporization. Unburned vaporized fuel is mixed with secondary airstreams indicated by arrows 34' and 36 in a secondary combustion area above the primary combustion chamber to form a ring-shaped, secondary combustion flame 54 in which the oxygen sensor 38 is positioned. The resistance value of the oxygen sensor 38 decreases with the increase in partial pressure of oxygen in the vicinity thereto so that the sensor 38 initially exhibits a low resistance value to maintain the wick 25 in the raised position. The tertiary airstreams 37 serve to burn the unburned fuel above the secondary combustion flame.

Figure 4:
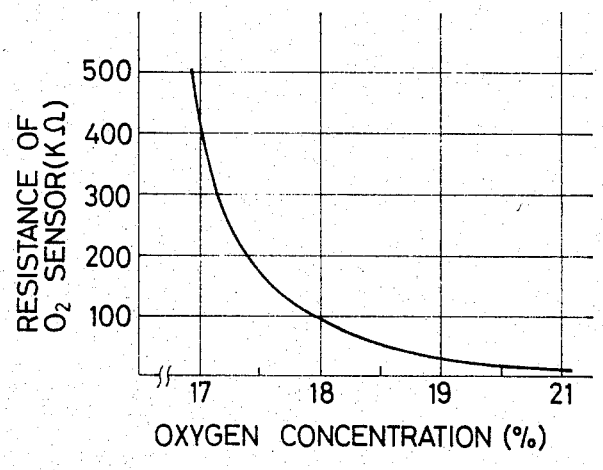
FIG. 4 is a graphic illustration of the operating characteristic of the oxygen sensor.

If the combustion is continued to consume the oxygen in a confined indoor limited space and the oxygen content reduces to 17% to 18%, the primary combustion flames 53 reduce in number and size reducing the temperature of the primary combustion chamber and hence the amount of fuel vapors. Therefore, the secondary combustion flame 54 diminishes and as a result the oxygen sensor 38 is displaced out of the flame. Since the primary, secondary and tertiary airstreams are still supplied at constant rates under the influence of the blower fan 1 regardless of the reduction of the fuel vaporizing temperature, the partial oxygen pressure around the oxygen sensor 38 rapidly reduces so that its resistance value increases following a curve as shown in FIG. 4. The sense circuit 52 de-energizes the relay S to open the circuit for the lever holding relay R2. The wick 25 is thus unlocked and restored to the original position, thus automatically extinguishing the burner.

The oxygen sensor 38 is preferably formed of $SnO_2$ as a principal constituent since the resistance value of this material is also variable inversely as a function of temperature, so that displacement of the secondary combustion flame 54 from the oxygen sensor 38 results in an increase in its resistance value and the burner is extinguished without failure in response to the occurrence of an oxygen shortage condition. Due to the placement of the oxygen sensor 38 within a flame, the displacement from the sensor 38 caused by abnormal operating conditions can also be detected to automatically quench the burner. Such abnormal conditions include a down draft of air generated when the burner is used in a windy environment and a formation of tar on the upper edge of the wick causing a poor capillary action.

The placement of the oxygen sensor 38 in the secondary combustion flame 54 has an advantage in that the secondary combustion flame 54, which occurs substantially in the final stage of combustion, is largely affected by the shortage of oxygen compared with the primary combustion flames 53. Otherwise stated, there is a larger amount of variation in partial oxygen's pressure in the final stage of combustion than in the initial stage of combustion in response to the presence of the dangerous condition. It is to be noted however that the oxygen sensor 38 could also be located in any of the flames 53 of primary combustion as shown at 55. In that instance the partial pressure of oxygen variation occurs quickly in the neighborhood of the primary combustion flames in response to the occurrence of the oxygen shortage condition compared with the corresponding variation which occurs belatedly in the secondary combustion flame.

Figure 5:
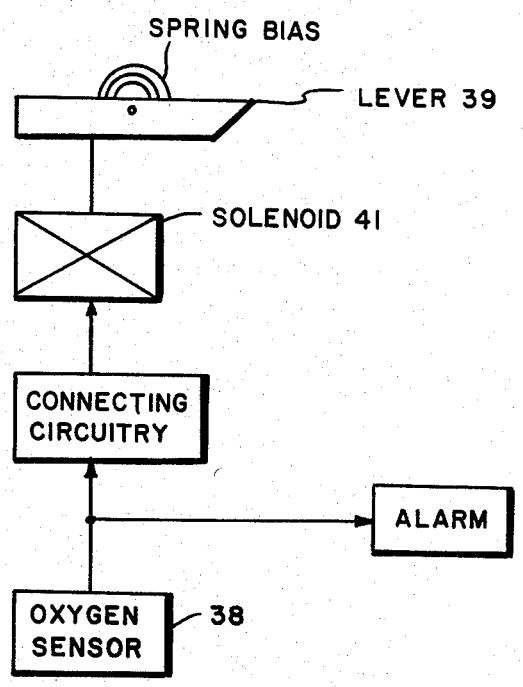
FIG. 5 shows a connection of an alarm and a wick positioning means to an oxygen sensor in accordance with the invention.

While in the foregoing description the burner of the invention is provided with an automatic flame extinguishing mechanism, a visual or audible warning device could also be employed instead of the flame extinguishing mechanism, as shown at FIG. 5.

What is claimed is:

1. A liquid fuel burner comprising:

a capillary wick partially immersed in a fuel tank for vaporizing the liquid fuel;

means for igniting the vaporized fuel;

perforated, concentrically arranged inner and outer members for defining a primary combustion area adjacent to an upper edge of said wick to provide combustion of said ignited vaporized fuel with primary air supplied through the perforation of said inner and outer members thereby generating a primary flame, and a third member defining a secondary combustion area above said primary combustion area and admitting secondary air to said secondary combustion area for effecting the combustion of unburned component of said fuel vapor with the secondary air thereby generating a secondary flame;

an oxygen sensor located in said secondary flame and providing an output signal; and a safety device operable in response to said output signal from said oxygen sensor, said safety device comprising electrical burner control means including:

safety means responsive to an output signal from said oxygen sensor for removing said wick from said primary combustion area;

first timing means for activating said means for igniting for a first predetermined time period after energization of said burner control means; and second timing means for locking said capillary wick in a predetermined position for a second predetermined time period after energization of said burner control means, said fuel burner comprising:

wick positioning means for positioning said wick to a raised position and power switch means responsive to said wick positioning means for energizing said burner control means when said wick is in said raised position, said wick positioning means responsive to said second timing means for locking said capillary wick in said raised position for said second predetermined time period upon activation of said power switch means, said safety means comprising further means for activating said wick positioning means to lock said capillary wick in said raised position in response to a signal from said oxygen sensor indicative of an oxygen concentration above a predetermined threshold and for deactivating said wick positioning means to unlock said capillary wick means in response to a signal from said oxygen sensing means indicative of an oxygen concentration less than said predetermined threshold.

2. A liquid fuel burner as claimed in claim 1, further comprising means for forcibly supplying said primary and secondary air to said primary and second combustion areas at a constant rate.

3. A liquid fuel burner as claimed in claim 1, wherein said safety device comprises means for automatically extinguishing said primary and secondary flames in response to said output signal.

4. A liquid fuel burner as claimed in claim 1, wherein said safety device further comprises means for generating a warning signal in response to said output signal from said oxygen sensor.

5. A liquid fuel burner as claimed in claim 1, wherein said oxygen sensor comprises tin oxide.

6. A liquid fuel burner as claimed in claim 1, further comprising:

a disk-shaped member spaced above an upper edge of said perforated inner member for admitting air to a point above said primary combustion area to provide secondary combustion of unburned fuel on the circumference of said disk-shaped member, wherein said oxygen sensor is located adjacent to the circumference of said disk-shaped member.

7. A liquid fuel burner as claimed in claim 1, wherein said wick positioning means comprises:

a spring-biased lever pivotally mounted with respect to said capillary wick for moving said wick to a raised position; and a solenoid for locking said lever to maintain said wick in said position until the occurrence of the output signal of said oxygen sensor.

8. A liquid fuel burner as claimed in claim 1, wherein said wick positioning means comprises:

pivotally mounted spring-biased lever means for moving said wick to said raised operative position; and solenoid means for locking said lever means to maintain said wick in said raised position only during indication of said sufficiently high partial pressure of oxygen.

9. An improved self-vaporizing liquid fuel burner as recited in claim 1 wherein said wick positioning means comprises lever means contacting said wick and biasing means biasing said lever to position said wick in an inoperative position, and said activating means comprises electrically operable means for counteracting said biasing means and for positioning said wick in an operative position when said output signal of said oxygen sensor is indicative of oxygen concentration above said predetermined threshold.

10. An improved self-vaporizing liquid fuel burner as recited in claim 9 wherein said electrically operable means comprises solenoid means.

11. An improved self-vaporizing liquid fuel burner as recited in claim 10 further comprising sensing circuit means responsive to said oxygen sensor for energizing and deenergizing said solenoid means responsively to said output signal of said oxygen sensor.

12. A fuel burner as claimed in claim 1, further comprising a disk-shaped member spaced above an upper edge of said perforated inner member for admitting additional secondary air to said secondary combustion area to provide secondary combustion of unburned fuel on the circumference of said disk-shaped member.

13. A liquid fuel burner comprising:

a capillary wick partially immersed in a fuel tank for vaporizing the liquid fuel;

means for igniting the vaporized fuel;

perforated, concentrically arranged inner and outer members for defining a primary combustion area adjacent to an upper edge of said wick to provide combustion of said ignited vaporized fuel with primary air supplied through the perforations of said inner and outer members thereby generating a primary flame, and a third member defining a secondary combustion area above said primary combustion area and admitting secondary air to said secondary combustion area for effecting the combustion of unburned component of said fuel vapor with the secondary air thereby generating a secondary flame;

an oxygen sensor located in said secondary flame;

electrical burner control means including safety means responsive to an output signal from said oxygen sensor for removing said wick from said primary combustion area to an inoperative position, first timing means for activating said means for igniting for a first predetermined time period after energization of said burner control means, and second timing means for locking said capillary wick in a predetermined position for a second predetermined time period after energization of said burner control means, wick positioning means for positioning said wick to a raised, operative position and power switch means responsive to said wick positioning means for energizing said burner control means when said wick is in said raised position, said wick positioning means responsive to said second timing means for locking said capillary wick in said raised position for said second predetermined time period upon activation of said power switch means, said safety means comprising further means for activating said wick positioning means to lock said capillary wick in said raised position in response to a signal from said oxygen sensor indicative of an oxygen concentration above a predetermined threshold and for deactivating said wick positioning means to unlock said capillary wick means in response to a signal from said oxygen sensing means indicative of an oxygen concentration less than said predetermined threshold, wherein said wick positioning means comprises lever means contacting said wick and biasing means biasing said lever to position said wick in said inoperative position, and electrically operable means for counteracting said biasing means and for positioning said wick in said raised, operative position when said output signal is indicative of oxygen concentration above said predetermined threshold, and alarm means responsive to said oxygen sensor for generating an alarm responsive to an output signal from said oxygen sensor indicative of an oxygen concentration below said predetermined threshold.

* * * * *